US005820938A

United States Patent [19]

Pank et al.

[11] Patent Number: 5,820,938

[45] Date of Patent: Oct. 13, 1998

[54] COATING PARENT BORE METAL OF ENGINE BLOCKS

[75] Inventors: Deborah Rose Pank, Saline; Matthew John Zaluzec, Canton; Oludele Olusegun Popoola, Grand Blanc; Robert Edward DeJack, Whitmore Lake; James R. Baughman, Plymouth; David James Cook, Farmington Hills, all of Mich.

[73] Assignee: Ford Global Technologies, INc., Dearborn, Mich.

[21] Appl. No.: 829,395

[22] Filed: Mar. 31, 1997

[51] Int. Cl.[6] ..... B05D 1/04; B05D 1/09

[52] U.S. Cl. ..... 427/449; 427/456; 427/470; 427/475; 427/486; 123/668

[58] Field of Search ..... 123/668; 427/470, 427/475, 449, 452, 456, 486

[56] References Cited

U.S. PATENT DOCUMENTS

| | | | |
|---|---|---|---|
| 2,588,422 | 3/1952 | Shepard . | |
| 2,756,495 | 7/1956 | Gale . | |
| 3,000,755 | 9/1961 | Hanink et al. . | |
| 3,546,415 | 12/1970 | Marantz | 219/76 |
| 3,667,111 | 6/1972 | Chartet | 29/495 |
| 3,887,497 | 6/1975 | Ulvild | 252/526 |
| 4,027,367 | 6/1977 | Bondau | 428/652 |
| 4,762,977 | 8/1988 | Browning | 219/121.47 |
| 4,911,351 | 3/1990 | Ishikawa et al. | 228/183 |
| 5,194,304 | 3/1993 | McCune, Jr. et al. | 427/449 |
| 5,245,153 | 9/1993 | Singer et al. | 219/76.15 |
| 5,268,045 | 12/1993 | Clare | 148/518 |
| 5,271,967 | 12/1993 | Kramer et al. | 427/455 |
| 5,296,667 | 3/1994 | Marantz et al. | 427/449 |
| 5,358,753 | 10/1994 | Rao et al. | 427/451 |
| 5,380,564 | 1/1995 | Van Kuiken et al. | 427/456 |
| 5,442,153 | 8/1995 | Marantz et al. | 219/121.47 |
| 5,468,295 | 11/1995 | Marantz et al. | 118/423 |
| 5,514,422 | 5/1996 | McCune | 427/449 |
| 5,592,927 | 1/1997 | Zaluzec et al. | 123/668 |

*Primary Examiner*—Michael Lusignan
*Assistant Examiner*—Fred J. Parker
*Attorney, Agent, or Firm*—Joseph W. Malleck

[57] ABSTRACT

A method of fluxing a cast light-weight metal substrate for thermally adhering sprayed metallic coatings thereto, comprising: (a) preparing the substrate to be clean of grease and oil and to have a uniform and homogeneous surface energy; (b) electrostatically depositing a dry flux powder coating onto such prepared surface; and (c) thermally depositing melted metal onto and across the flux coated surface to further thermally activate the flux if not already activated, for stripping away any substrate oxides and to thermally metallurgically bond the deposited molten metal to the substrate.

10 Claims, 4 Drawing Sheets

COATING PARENT BORE METAL OF ENGINE BLOCKS

BACKGROUND OF THE INVENTION

1. Technical Field

This invention relates to the technology of spraying cast cylinder bore surfaces (parent bore metal) of engine blocks with a lubricious wear resistant metallic coating, and more particularly to dry powder fluxing of such cylinder bores, which flux is thermally activated by the deposition of hot sprayed metal droplets thereover to metallurgically adhere to the cylinder bore surfaces.

2. Discussion of the Prior Art

Within the technology for thermally spraying coatings onto light weight metal substrates, it remains a problem how to more cost-effectively prepare the cast aluminum engine block bores to strongly metallurgically bond with the molten droplets projected there against from thermal spraying. Cast aluminum substrates are characteristically somewhat porous, non-homogenous and melt at a lower temperature when compared to cold-rolled aluminum products. This places new demands on the type and manner of fluxing to achieve economy.

Many different roughening techniques have been employed on aluminum to create a mechanical bond that augments or substitutes for metallurgical bonding; these roughening techniques have included grit blasting, spiral machine grooving, electrical discharge roughening, and high pressure water jetting. These roughening techniques fall short of the goal of cost effectiveness because of either the cost of equipment, risk of contamination or the inability to control the desired degree of roughness. Efforts have been made to use chemical etching, followed by immediate thermal spraying at high velocity and greater volumes, but adherence has not been optimum and is sometimes accompanied by substrate distortion due to a high content of heat transfer.

It would be desirable if chemical fluxes could be economically applied with thermal activation by the sprayed metal thereover to function immediately upon contact by molten metal droplets of such spraying to strip the aluminum substrate of any oxides. Commercial fluxes, now in use in the automotive industry for joining aluminum parts, are unsatisfactory when applied to fluxing cast metals for thermal spray because (i) they have a composition that melts in a range that overlaps the melting range of cast aluminum or aluminum alloys, and (ii) they are usually applied by wet techniques that require stirring of the solution to maintain flux suspensions, present difficulty in holding the wet flux to the desired target surface and requires drying steps to prepare the flux for use. Any attempt to use dry powder fluxes, has been only with respect to horizontal surfaces to retain the powder in place during use.

SUMMARY OF THE INVENTION

The invention in a first aspect is a method of fluxing a cast light-weight metal substrate for thermally adhering sprayed metallic coatings thereto, comprising: (a) preparing the substrate to be clean of grease and oil and to have a uniform surface tension; (b) electrostatically depositing a dry flux powder coating onto such prepared surface; and (c) thermally depositing melted metal onto and across the flux coated surface to further thermally activate said flux, if not already activated, for stripping away any substrate oxides and to thermally metallurgically bond the deposited molten metal to the substrate.

The invention, in a second aspect, is a method of coating a series of adjacent cylinder bores surfaces of a cast aluminum engine block, the bore surfaces having a preconditioned surface roughness of less than 50 microns Ra, comprising: (a) washing the surfaces with an aqueous solution of non-etching alkaline cleaning agent comprising borate, carboxylic acid and sodium gluconate, the agent being effective to increase and make more homogeneous the surface energy of the preconditioned surfaces (the washing being preferably carried out in stages where a first washing solution at a pressure of about 20–100 psi is used for 10–60 seconds, thence a second solution at a pressure of about 1000 psi for 10–60 seconds, and finally a solution again at a pressure of 20–100 psi for about 10–60 seconds) (b) after drying said surface, electrostatically applying a dry dehumidified non-corrosive brazing flux that clings to the washed surface in a uniform coating thickness of about 10 micrometers or less, and (c) thermally spraying adjacent bore surfaces at the same time (with two synchronized thermal spray guns which synchronously rotate in the same direction, the guns may apply a transition bonding metal or a top coat), the metal coating thermally activating the deposited flux to strip substrate oxides, and (d) removing metal of the last coated material to a surface finish of 0.1–0.4 micrometers Ra. The guns employ a propellant gas flow of at least 4000–6000 cfm to assist cooling of the coated blocks and avoid thermal bore distortion. The electrostatically applied dry flux has a chemistry consisting of eutectic mixtures of $KAlF_4$ and $K_3AlFb_1$ with additions of CeF and LiF salts. The flux is characterized by a melting range lower than the melting range for the cast aluminum or aluminum alloy component (such as in the range of 480° C.–580° C.).

DETAILED DESCRIPTION AND BEST MODE

Figure 1:
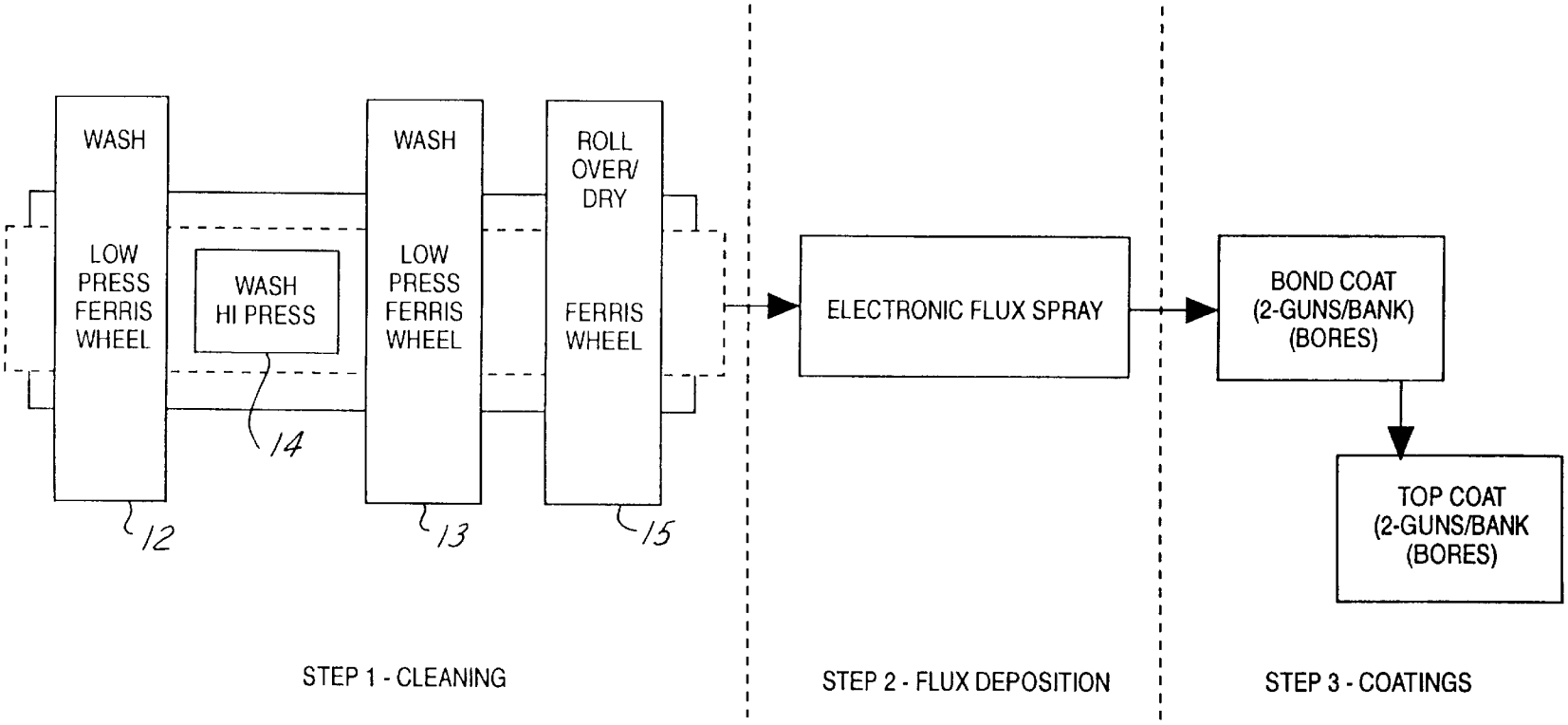
FIG. 1 is a schematic flow diagram showing the sequence of the method of this invention depicting the steps of washing, fluxing, bond coating, top coating and honing.
Figure 2:
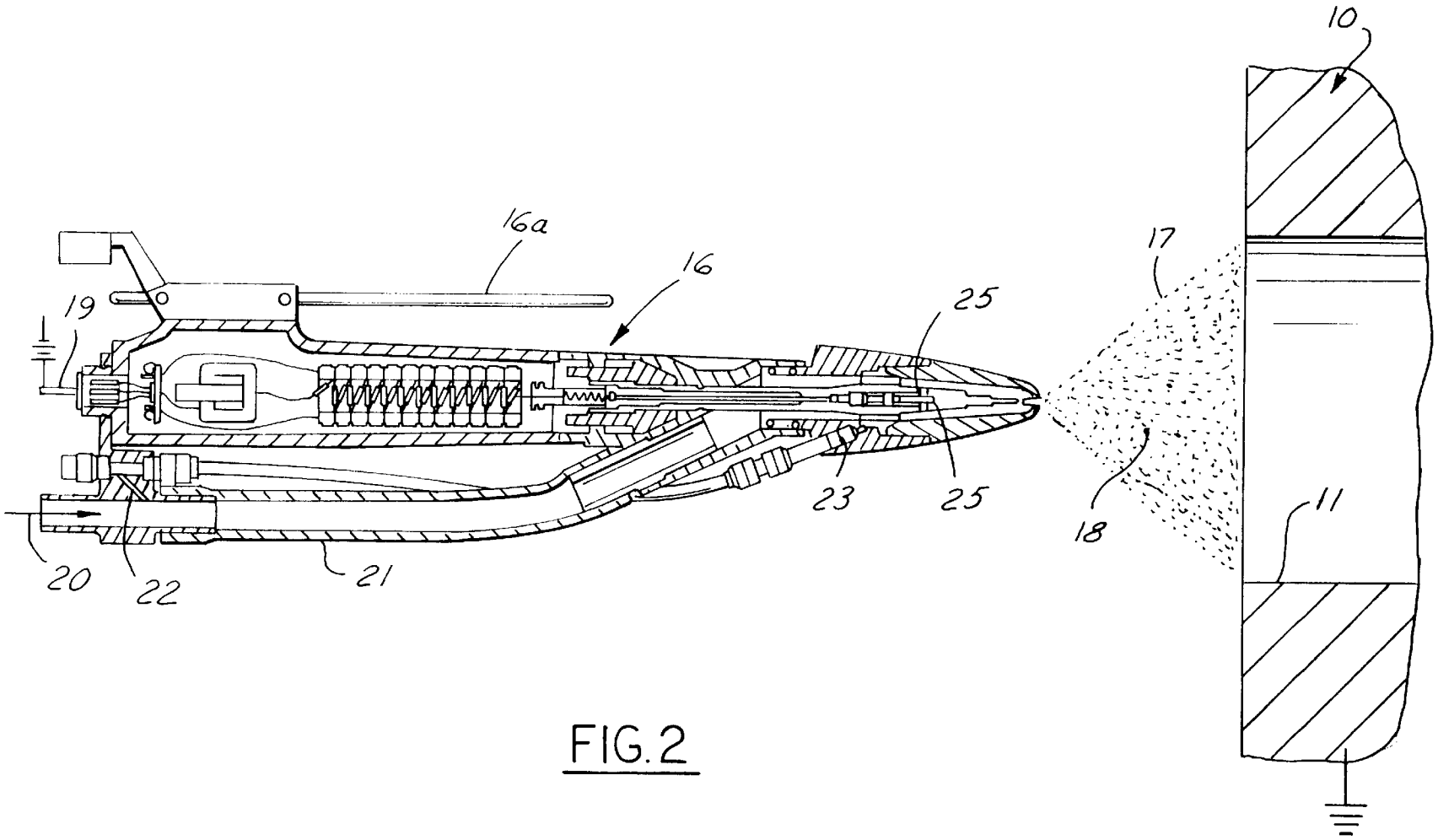
FIG. 2 is a cross-sectional elevational view of an electrostatic flux spraying apparatus showing how the apparatus is deployed to apply the dry flux to one cylinder bore of an engine block.

As shown in FIGS. 1 and 2, the method herein of fluxing thermally sprayed coatings, requires preparation and cleaning of the substrate surface, (2) electrostatic deposition of a dry powder flux, and (3) thermal activation of the dry flux (if not earlier activated) by thermal spraying of melted metallic droplets that simultaneously activate the flux and deposit a metallic coating. Surface preparation comprises starting with a cast light-weight metal component 10, such as an aluminum alloy engine block having a plurality of cylinder bore surfaces 11. Such cast cylinder bore surfaces 11 preferably have a preconditioned surface finish of less than 50 microns Ra, which finish may be obtained by conventional rough machining of the cast bore surfaces 11. Such machined surfaces will have a porosity of about 3% and a melting temperature in the range of 580° C.–660° C.

The preconditioned surfaces are processed through two low pressure washing stations 12 and 13 (20–100 psi) separated by a high pressure washing station 14 (about 1000 psi). Jets of an aqueous washing solution are formed by pressurized washing nozzles, the washing solution containing about 16% by weight borate, 15% carboxylic acid, about 2% sodium gluconate and the remainder essentially water. Such solution chemistry is advantageous because it contains unique surfactants that synergistically influence the surface energy of the aluminum (or other light-weight metal) bore surface to facilitate uniform electrostatic deposition of the dry flux. The engine blocks 10 are carried by a ferris wheel as they are sprayed. Surface oils and any grease are removed by the first low pressure washing jets. Oils contained in the cast pores of the block are removed by high pressure jets as the blocks are linearly conveyed through the high pressure station 14. Any residue of surface oils are then removed by the second low pressure washing jets at station 13, as the blocks are circulated on a ferris wheel frame. The blocks are then inverted (rolled over to have the deck side up) and exposed to a drying medium such as hot air at station 15, while carried in a ferris wheel frame. Low pressure washing and drying on a ferris wheel is advantageous because it thoroughly cleans all internal cavities of residual machining chips, sand and debris. The unique chemical surfactants of the washing solution modify the surface tension of the washed cast metal surface to be very uniform and conductive to absorption of flux particles and to have a chemical affinity for the flux powder.

In the second step of the process, electrostatic fluxing is carried out by use of a spraying gun 16 that introduces a cloud 17 of electrically charged dry powder flux particles 18 to the interior prepared cylinder surface 11 which is electrically connected to ground (as shown in FIG. 2). The low voltage power connection 19 to the main electrode 25 is shown in FIG. 2; air flow pressure 20 provides a continuous flow of powder fluxing thru line 21; a fluidizing pressure 22 is created by directing part of an air supply to keep the powder flux in suspension and properly mixed; atomizing pressure 23 is created by directing the remainder of the air supply to the nozzle about electrode 25. An ion collector rod 16*a* is used to shield the gun from unwanted charges.

Figure 3:
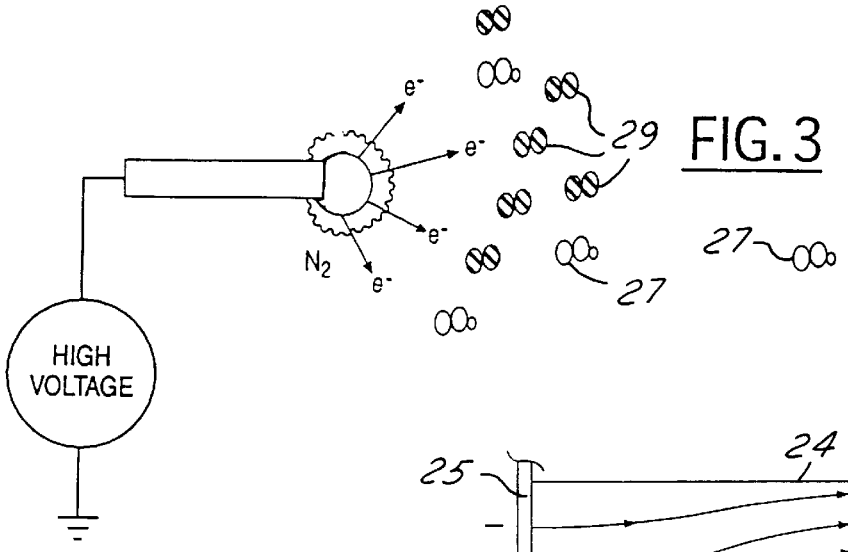
FIG. 3 is an illustration of how the flux gun electrode ionizes the surrounding air to create a corona.
Figure 4:
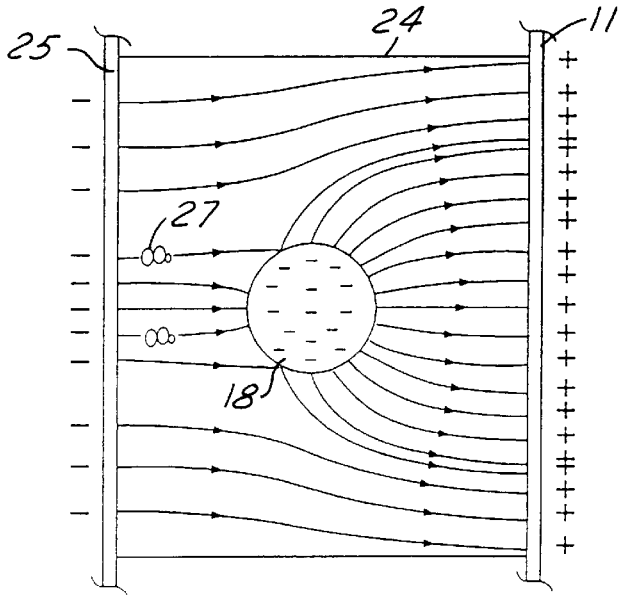
FIG. 4 is a schematic diagram of the electrical field between the gun and engine block and how such field is affected by charged powder particles.

The phenomenon underlying the electrostatic fluxing can best be understood by reviewing parameters that must be adjusted to obtain the desired result. As shown in FIGS. 3 and 4, an electrical field 24 is stabilized between the small pointed charging electrode 25 of the gun 16 and the target cylinder bore surface 11. When the voltage of the electrode 25 is high enough to concentrate enough charge in a small space, the electric field 24 becomes strong enough to ionize (strip electrons off) surrounding air molecules to form a corona 26 (about 4 million volts per meter) that is a cold plasma. The corona contains free electrons 28 and thus is a conductive pathway (usually about 2 millimeters in diameter). There is a strong repulsion between the charging electrode 25 and the corona 26 because they are both biased strongly negative; electrons are accelerated outward into the surrounding air to be captured by an oxygen molecule 29 to form an ion 27. It is these ions which actually charge the flux powder.

The introduction of powder flux 18 distorts the electric field 24 so as to be concentrated near the particles 18 as shown in FIG. 4. The larger the powder particle 18, the greater the concentration. Since the ions 27 have a net charge, the electrical field will affect them, pushing them away from the electrode 25 and toward the target surface 11 subject to influence by the distorted field to thereby impact the powder particles 18 and transfer their charge.

Figure 5:
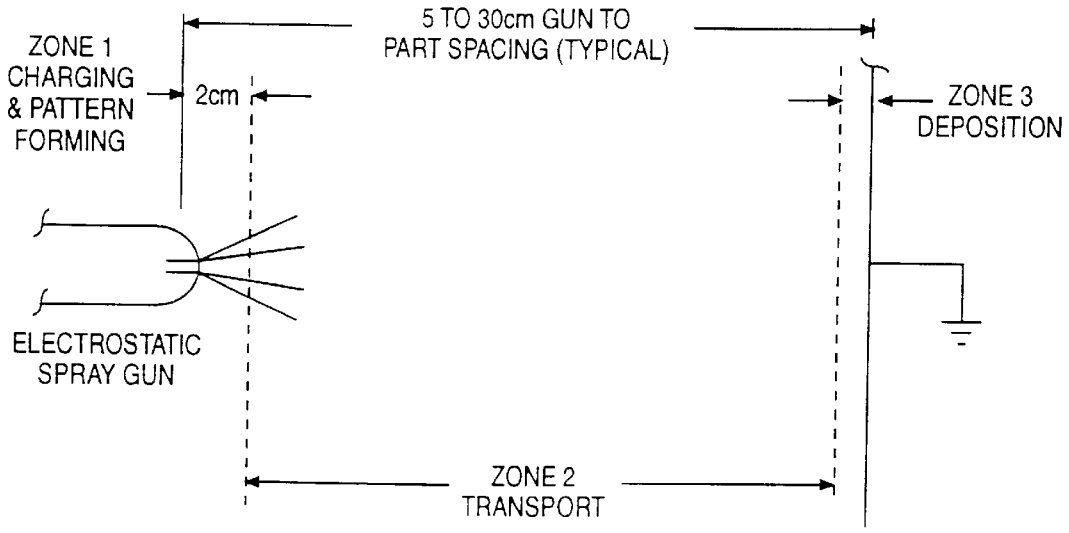
FIG. 5 is an illustration of the zones through which the flux powder particles are electrostatically transported.

Thus, in zone 1 as shown in FIG. 5, powder particle charging and powder pattern forming takes place. This zone is immediately around the exit end 30 of the spray gun 16 for a distance of about 2 centimeters. To recap, in this zone the following occurs: the high voltage power supply charges the electrode, the concentrated charge creates a very strong electric field, the strong field breaks down the air and causes a corona to form, the corona emits electrons, the electrons are captured by oxygen molecules to form negative ions, the ions are urged to follow the field lines, the powder particles distort the field around themselves, the distorted field directs the ions to the powder particles, and the powder particles are bombarded by the ions to become charged. Pattern formation in zone 1 is established through the shape of the nozzle 31, air deflectors 32 or air jets entering the spray booth and surrounding the block. It is also a region of high velocity, where air moves through quite rapidly (in a time period of about 4–6 milliseconds). But since it would be desirable to have a greater time dwell in this zone, the air flow should be controlled to be as soft as possible.

Figure 6A:
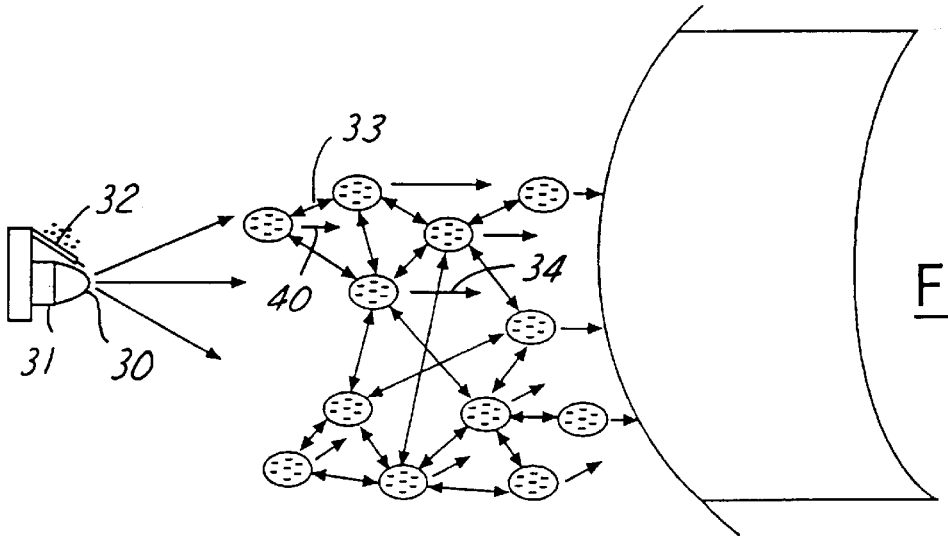
FIGS. 6*a* and 6*b* depict the different forces acting on the charged flux powder particles.
Figure 6B:
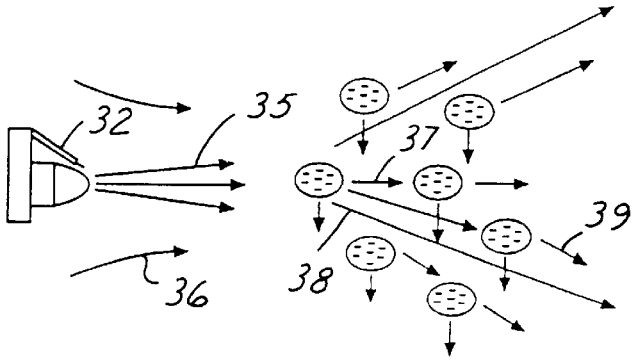

In zone 2 of FIG. 5, the charged powder is moved to the target surface 11 predominantly by air flow and to a minor extent by electrostatics. In zone 3, (about 1 centimeter thick) a number of forces are working on each particle. First, and as shown in FIG. 6*a* there are several electrical field forces: the field 40 from the gun which is pushing the particles to the cylinder bore surface; the field 34 from the charged particle attracting it to the target; and interactions 33 between the fields from the individual particles as they repel each other, since all have the same polarity of charge. Secondly, there are the effects of aerodynamics and inertial forces as shown in FIG. 6*b*. There is the effect of both the gun air flow 35 and the booth's air flow 36 on the particle. There are inertial forces 37 due to the particle's mass and momentum, and due to gravity 38. There are also the aerodynamic effects 39 from the cylinder bore surface; particles which approach at right angles to the bore surface have the best chance of being captured (electrostatically attracted), than those traveling parallel to the cylinder bore surface 11. Due to the significant repulsion forces between powder particles 18, few particles will be traveling parallel to the bore surface except for aerodynamic effects which must be modified to increase their angle of attack (transfer efficiency begins to suffer when air velocity near the surface exceeds 30 feet per minute).

Turning to specific parameters of electrostatic spraying, the flux powder is comprised of a fluoride salt that melts at a temperature well below that for the cast metal substrate (preferably at a temperature differential of 30°–80° C. below). For cast aluminum (such as 319–356, 380, 390 aluminum alloys that contain Si, Cu, Mn or Fe each in amounts of 0.5–5% by weight and produce a cast metal that has a melting temperature of 580°–660° C.), a eutectic double salt mixture of fluoroaluminum possesses such a lower melting temperature at about 560° C. Other equivalent flux powders for use with aluminum may include CsF, $L_1F$, and KF. The flux powder that is fed into the spray gun advantageously has a particle diameter of less than 10 microns, 70% of which is in the range of 2–4 microns. It is desirable that the particle size of the powder be as large as possible to facilitate electrostatic attraction. As indicated, the flux is selected preferably to be a eutectic comprising a double fluoride salt having the phase formula gamma. $K_3A_1F_6+KAlF_4$. Such eutectic contains $AlF_3$ at about 45 mole % of the double fluoride salt, with KF being about 55 mole %. The eutectic has a melting temperature of about 560° C. which is about 40° C. below that of the cast alloy of the substrate. If the double fluoride salt has a substantially different molar percentage of $AlF_3$ (thus not being an eutectic) the melting temperature will rapidly rise. Other double fluoride salts, and for that matter other alkaline metal fluoride or fluoride salts can be used as long as they have a melting temperature that can be heat activated without disturbing the cast aluminum alloy. Chloride salts are useful, but are undesirable because they fail to provide corrosion resistance on the aluminum product, and may attack aluminum alloy grain boundaries.

When the voltage of the gun is about 100 kv for the primary electrode, the powder velocity leaving zone 1 of the gun is about 0.1–1 m/s. The shape of the particles 18 is desirably spherical to facilitate aerodynamic transport. Utilizing a gun with such voltage, the exit charge of the corona from such gun is about 1–50 Tesla. The dry fluidized flux particles as electrostatically charged are sprayed onto the cylinder bore surface under a flow pressure 20 of about 2.5 psi, an atomizing pressure 23 of 2.5–3 psi and a fluidizing pressure 22 of about 5.0 psi. The total surface roughness of the bore surface 11 prior to receiving such flux is less than 50 microns but preferably between 5–20 microns. Dry flux is sprayed onto the prepared surface in a density of about 3–6 grams per square meter preferably about 5 grams per square meter. Although some of the particles will fall off, a substantial portion will cling to the substrate and be neutralized in charge as a result of such attraction. Particles that are permanently retained on the bore surface do so by Van Der Waals forces (natural attraction between charged particles). No wet chemistry is required to apply the flux and no dehumidification is necessary.

Step 3 comprises concurrent thermal activation of the dry flux 18 by deposition of melted metal droplets that create a metallurgically bonded coating on the flux coated cylinder bore surface. Deposition is carried out by thermal spraying, and preferably by plasma transferred wire arc (PTWA) such as disclosed in U.S. Pat. No. 5,442,153, using a single wire feedstock.

For wire arc thermal spraying, the process comprises feeding one or more solid wire feedstocks 41 down a rotatable and reciprocating journal shaft 42 so that the wire tip 43 can act as an electrode and promote an electrical arc 44 with the gun nozzle through which a gas can be projected. Electrical current from a power source is passed through the wire to create such arc 44 across the gap 48 with the nozzle, while pressurized gas 49 is directed through the gap to spray fully molten droplets from the wire tips 43. Droplets 50 are projected as a result of the force of the gas onto the sprayed target.

To effect concurrent thermal activation of the flux by the deposit of melted droplets from the wire, process parameters for the thermal gun must be employed to assure a super heated molten spray of particles 50. This involves an 80–220 voltage range for the thermal arc spray gun and an amperage of 60–100 amps, to adequately sustain the arc in the gun nozzle. The feedstock for the bond coat 51 is preferably a wire constituted of nickel-aluminum, having a diameter of about 0.062" (1/16") although equivalent bond materials may comprise aluminum-bronze, iron-aluminum, or silicon bronze.

The initial contact of the first spray particles, which are usually at a temperature in excess of 1000° C., will thermally activate the dry flux, causing it to be melted and immediately actively strip the metal surface of oxides. Thermal spraying is continued beyond thermal activation of the flux to deposit a metallic bond coating 51 in a thickness of about 30–70 microns. The heat content of such thermally sprayed bond coat will be conducted readily through the entire cast engine block.

A final thermally sprayed top coating 52 of a low carbon alloy steel or preferably a composite of steel and FeO is provided. If a composite top coating is desired, the wire feedstock is comprised of a low carbon, low alloy steel and the secondary gas (shrouding the plume from the arc) is controlled to permit oxygen to react with the droplets to oxidize and form the selective iron oxide $Fe_xO$ (wustite, a hard wear resistant oxide having a self lubricating property). The composite coating thus can act very much like cast iron that includes graphite as an inherent self lubricant. The gas component containing the oxygen can vary between 100% air (or oxygen) and 100% inert gas (such as argon or nitrogen) with corresponding degrees of oxygenation of the Fe. The feedstock materials for the composite coating include low carbon steel feedstocks, low alloy feedstock, 3000 series stainless steel feedstock and 400 series stainless feedstocks and 400 series stainless steel feedstock, all of which can produce a composite coating containing iron oxide particles for wear and scuff resistance. The final top coat will have a sprayed thickness typically about 250–600 microns.

Figure 7:
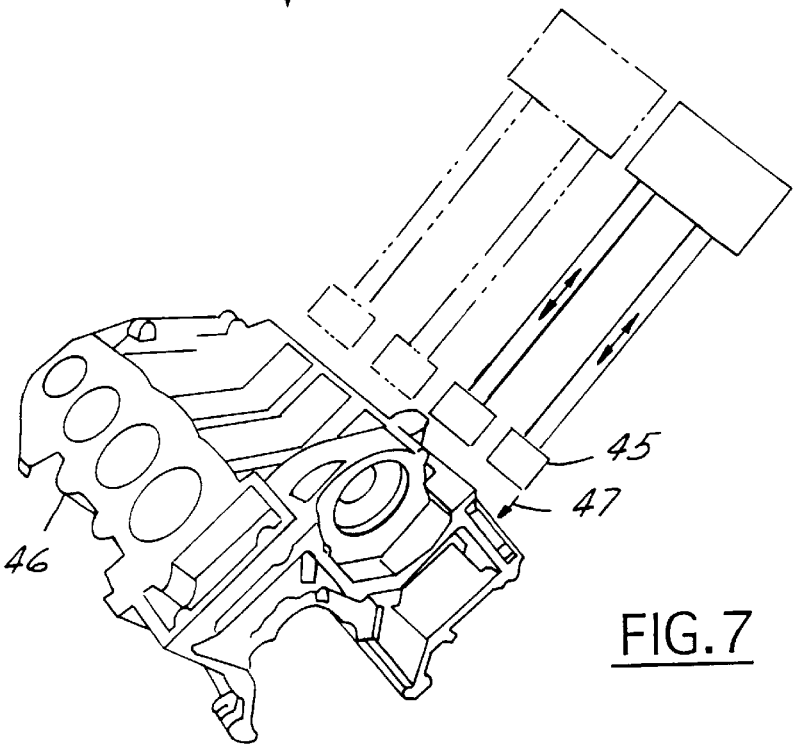
FIG. 7 is a schematic diagram of 2 or more thermal spray guns synchronized to spray adjacent bores of an engine block.

To increase productivity, this invention contemplates thermally spraying adjacent cylinder bores at the same time with synchronously tied spray guns 45 (as shown in FIG. 7). To prevent excessive heat accumulation in the bridge areas 46 between adjacent bores, the guns 45 for such synchronized spraying are tied together to point in the same radial direction during application and thereby never traverse an intervening bridge area 46 at the same time. To assist in keeping such bridge temperature reduced, the plasma and gas envelope used to carry out thermal spraying are controlled to provide an air flow 47 of 4000–6000 cfm through the bore. This allows the bridge area to remain at a temperature below 275° C., well below the threshold temperature at which distortion may occur. Such air flow also facilitates the formation of lubricious phases such as FeO if an iron or stainless wire feedstock is employed. Synchronous thermal spraying of adjacent bores can be carried out for both bond and top coats. Compared to thermally spraying bores in sequence by a single gun, the time interval between gun positioning can be reduced by 50%.

After the bond and top coats are applied, the coated aluminum engine block is finished by way of a direct hone process to achieve a suitable cylinder bore surface finish for engine applications. The use of diamond hone stones in water-based honing fluids has been found to be effective in achieving the final honed surface finish, comparable to or better than that achievable with cast iron liner engines. The finishing operation reduces the total coating thickness to that of about 150 microns. In some instances it may be desirable to subject the coated engine block to a temperature stabilizing step in order to provide increased mechanical strength and hold geometric tolerances.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of fluxing a thermally sprayed coating, comprising;

(a) preparing a cast metallic substrate surface to be clean of oil and grease while possessing surface oxide;

(b) electrostatically depositing a dry flux powder onto said prepared substrate surface; and (c) thermally depositing melted metal onto and across said electrostatically fluxed surface to thermally activate said flux for stripping away any substrate oxides and for metallurgically bonding the sprayed metal as a coating to the cast metallic substrate.

2. The method as in claim 1 in which the particle size distributions of the dry flux powder applied in step (b) is in the range of 5–100 micrometers.

3. The method as in claim 1, in which step (b) is carried out to electrostatically spray the dry flux powder at a flow pressure of about 2.5 psi (atomizing pressure of 3 psi) accompanied by an exit charge of 1–50 Tesla.

4. The method as in claim 1, in which said thermally deposited metal in step (c) is comprised of a bonding metal selected from the group of nickel-aluminum, aluminum-bronze, and silicon bronze.

5. The method as in claim 1, in which said thermal deposition is carried out by the use of wire arc, high velocity oxy-fuel, or powder plasma thermal spraying to provide superheated metal droplets at a temperature in excess of 1000° C.

6. The method as in claim 5, in which said wire arc spraying is carried out utilizing a spray gun having voltage of 80–220 volts and a current of 60–100 amps.

7. A method of coating adjacent cylinder bore surfaces of a cast aluminum engine block, the surfaces having a bridge wall separating the bore surfaces and having a preconditioned surface with a roughness of less than 50 microns Ra, comprising:

(a) washing said surfaces with an aqueous solution of non-etching alkaline cleaning agent comprising borate, carboxylic acid and sodium glucoanate, said agent being effective to increase and make homogeneous the surface energy of said preconditioned surface, (b) after drying said surfaces, electro-statically applying a dry dehumidified brazing flux that clings to said washed surfaces in a uniform coating thickness of 10 micrometers, (c) thermally spraying said adjacent bore surfaces at the same time with a bonding metal to simultaneously (i) thermally activate said electrostatically deposited dry flux to strip said surfaces of oxides, and (ii) metallurgically adhere said bonding metal to the stripped surfaces, (d) thermally spraying a top metal coat over said bonding metal in each bore to metallurgically adhere thereto, said thermal spraying utilizing atomizing air that is pumped through said bores to cool said engine block and avoid distortion causing engine block heating at the bridge walls between said adjacent bores, and (e) removing a portion of said top metal coat to finish said coated surface to a roughness of 0.1–0.4 micrometers Ra.

8. The method as in claim 7 in which, step (a) is carried out in stages, using said solution pressurized sequentially at about 20–100 psi, 1000 psi, and 20–100 psi.

9. The method as in claim 7, in which the deposited thickness of said bonding metal is in the range of 30–70 microns, and said bonding metal is applied by thermal guns, each rotated about its own axis, said guns being synchronized to rotate in the same direction with said axes being parallel.

10. The method as in claim 7, in which said top metal is selected from the group consisting of low carbon steel, low alloy steels, 3000 series stainless steel, 400 series stainless steel and, said thermal spraying for the top coat being carried out with an excess of oxygen in the propellant gas to oxidize a portion of said thermally sprayed top metal to FeO.

* * * * *